US006563466B2

(12) United States Patent
Sadler et al.

(10) Patent No.: US 6,563,466 B2
(45) Date of Patent: May 13, 2003

(54) MULTI-FREQUENCY BAND INVERTED-F ANTENNAS WITH COUPLED BRANCHES AND WIRELESS COMMUNICATORS INCORPORATING SAME

(75) Inventors: Robert A. Sadler, Raleigh, NC (US); Mohammod Ali, Cary, NC (US); Gerard James Hayes, Wake Forest, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/963,755

(22) Filed: Sep. 26, 2001

(65) Prior Publication Data

US 2003/0058168 A1 Mar. 27, 2003

(51) Int. Cl.[7] ..... H01Q 1/24
(52) U.S. Cl. ..... 343/702
(58) Field of Search ..... 343/700 MS, 702, 343/893

(56) References Cited

U.S. PATENT DOCUMENTS 6,407,710 B2 * 6/2002 Keilen et al. ..... 343/702

* cited by examiner

*Primary Examiner*—Michael C. Wimer

(74) *Attorney, Agent, or Firm*—Myers Bigel Sibley & Sajovec

(57) ABSTRACT

Multi-frequency band antennas for use within wireless communicators, such as radiotelephones, are provided and include a first conductive branch configured to radiate in a first frequency band and a second conductive branch configured to radiate in a second frequency band that is different from the first frequency band. The first conductive branch includes opposite first and second end portions and opposite first and second edge portions that extend between the first and second end portions. A notch is formed in the second edge portion adjacent the second end portion. The second conductive branch includes opposite third and fourth end portions and opposite third and fourth edge portions that extend between the third and fourth end portions. The first and second conductive branches are connected together at the first and third end portions and are configured to electrically couple at the respective second and fourth end portions. Coupling is utilized between the first and second conductive branches to achieve bandwidth and gain results desired for the antenna.

35 Claims, 13 Drawing Sheets

MULTI-FREQUENCY BAND INVERTED-F ANTENNAS WITH COUPLED BRANCHES AND WIRELESS COMMUNICATORS INCORPORATING SAME

FIELD OF THE INVENTION

The present invention relates generally to antennas, and more particularly to antennas used with wireless communicators.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones must include an antenna for transmitting and/or receiving wireless communications signals.

Radiotelephones and other wireless communicators are undergoing miniaturization. Indeed, many contemporary radiotelephones are less than 11 centimeters in length. As a result, there is increasing interest in small antennas that can be internally mounted within the housings of radiotelephones so as not to be visible to users.

In addition, it may be desirable for radiotelephones to operate within multiple frequency bands in order to utilize more than one communications system. For example, GSM (Global System for Mobile) is a digital mobile telephone system that typically operates at a low frequency band (frequency band of operation: 880–960 MHz). DCS (Digital Communications System) is a digital mobile telephone system that typically operates at high frequency bands (frequency band of operation: 1710–1880 MHz). The frequency bands allocated in North America are 824–894 MHz for Advanced Mobile Phone Service (AMPS) and 1850–1990 MHz for Personal Communication Services (PCS). Accordingly, internal antennas, such as inverted-F antennas are being developed for operation within multiple frequency bands.

Inverted-F antennas may be well suited for use within the confines of radiotelephones, particularly radiotelephones undergoing miniaturization. As is well known to those having skill in the art, conventional inverted-F antennas include a conductive element that is maintained in spaced apart relationship with a ground plane. Exemplary inverted-F antennas are described in U.S. Pat. Nos. 5,684,492 and 5,434,579 which are incorporated herein by reference in their entirety.

Unfortunately, conventional inverted-F antennas typically resonate within narrow frequency bands. In addition, conventional inverted-F antennas may occupy more volume as compared with other types of antennas. As such, a need exists for small, internal radiotelephone antennas that can operate within multiple frequency bands.

SUMMARY OF THE INVENTION

In view of the above discussion, multi-frequency band antennas for use within wireless communicators, such as radiotelephones, according to embodiments of the present invention, include a first conductive branch that is configured to radiate in a first frequency band and a second conductive branch that is configured to radiate in a second frequency band that is different from the first frequency band. The first conductive branch includes opposite first and second end portions and opposite first and second edge portions that extend between the first and second end portions. A notch may be formed in the second edge portion adjacent the second end portion. The second conductive branch includes opposite third and fourth end portions and opposite third and fourth edge portions that extend between the third and fourth end portions. The first and second conductive branches are connected together at the first and third end portions and are configured to electrically couple at the respective second and fourth end portions. Coupling is utilized between the first and second conductive branches to achieve bandwidth and gain results desired for the antenna.

A first conductive element having a free end extends from the third edge portion of the second conductive branch adjacent the fourth end portion. The first conductive element free end is spaced-apart from the second edge portion of the first conductive branch by a distance of less than about ten millimeters (10 mm) and preferably less than about five millimeters (5 mm). The notch is in adjacent, spaced-apart relationship with at least a portion of the first conductive element free end and facilitates electrical coupling between the first and second conductive branches so as to enhance radiation efficiency in at least one of the first and second frequency bands.

A second conductive element extends from the first edge portion of the first conductive branch adjacent the first end portion and includes a wireless communications signal feed terminal and a ground feed terminal. A third conductive element extends from the first edge portion of the first conductive branch at an intermediate location between the first and second end portions. The third conductive element is configured to tune the first frequency band. A fourth conductive element extends from the third end portion of the second conductive branch and is configured to tune both the first and second frequency bands. A fifth conductive element extends from the fourth end portion of the second conductive branch and is configured to tune the second frequency band.

Antennas according to embodiments of the present invention are configured to be disposed on and/or within dielectric substrates and mounted internally within wireless communicators, such as radiotelephones, in adjacent, spaced-apart relationship with a ground plane. The inside surface of a wireless communicator housing may serve as a substrate and antennas according to embodiments of the present invention may be printed on the housing surface. A foam material may also serve as a substrate according to embodiments of the present invention.

Antennas according to embodiments of the present invention may be particularly well suited for use within wireless communicators, such as radiotelephones, wherein space limitations may limit the performance of internally mounted antennas. Moreover, antennas according to embodiments of the present invention may be particularly well suited for operation within multiple frequency bands.

DETAILED DESCRIPTION OF THE INVENTION

Figure 1:
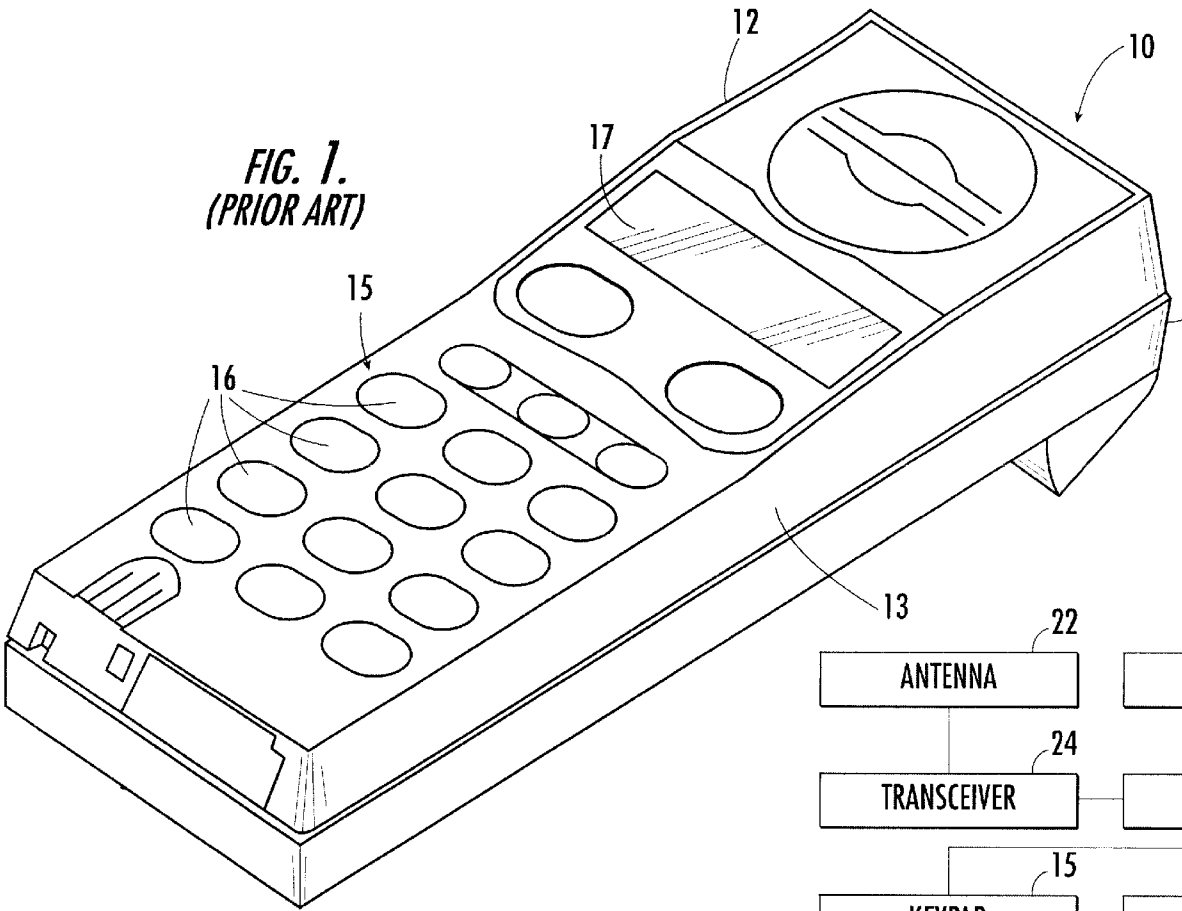
FIG. 1. (PRIOR ART)
FIG. 1 is a perspective view of an exemplary radiotelephone within which an antenna according to embodiments f the present invention may be incorporated.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of lines, layers and regions may be exaggerated for clarity. It will be understood that when an element such as a layer, region or substrate is referred to as being "on" another element, it can be directly on the other element or intervening elements may also be present. In contrast, when an element is referred to as being "directly on" another element, there are no intervening elements present. It will be understood that when an element is referred to as being "connected" to another element, it can be directly connected to the other element or intervening elements may also be present. In contrast, when an element is referred to as being "directly connected" to another element, there are no intervening elements present.

Referring now to FIG. 1, a wireless communicator (e.g., a radiotelephone) 10, within which multi-frequency band antennas according to various embodiments of the present invention may be incorporated, is illustrated. The housing 12 of the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

It is understood that antennas according to the present invention may be utilized within various types of wireless communicators and are not limited to radiotelephones. Antennas according to the present invention may also be used with wireless communicators which only transmit or receive wireless communications signals. Such devices which only receive signals may include conventional AM/FM radios or any receiver utilizing an antenna. Devices which only transmit signals may include remote data input devices.

Figure 2:
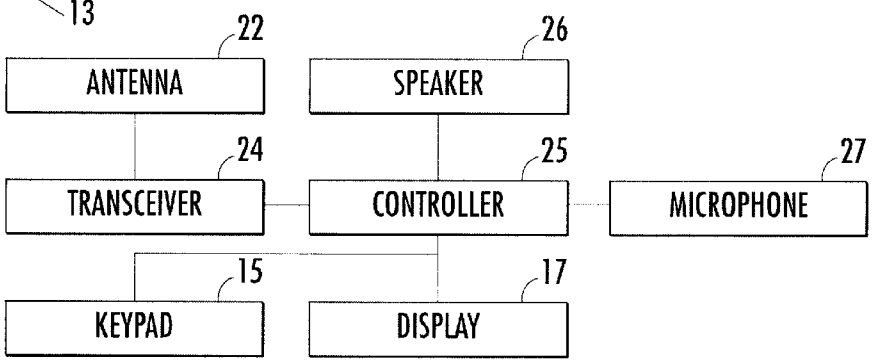
FIG. 2. (PRIOR ART)
FIG. 2 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency (RF) transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

As is known to those skilled in the art of communications devices, an antenna is a device for transmitting and/or receiving electrical signals. On transmission, an antenna accepts energy from a transmission line and radiates this energy into space. On reception, an antenna gathers energy from an incident wave and sends this energy down a transmission line. As understood by those skilled in the art, the criteria that defines the performance of an antenna is referred to as "gain." The term "gain" indicates how directive or focused an antenna is in terms of radiating energy in a preferred direction, and how efficient an antenna is (e.g., how much input power is actually radiated during transmission).

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to compensate for undesired antenna impedance components to provide a 50 Ohm (Ω) (or desired) impedance value at the feed point.

Figure 3A:
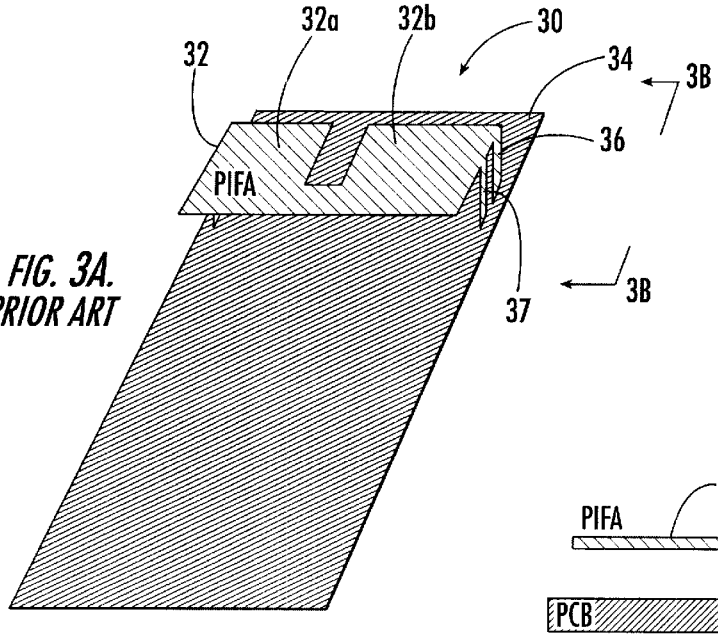
FIG. 3A. PRIOR ART
FIG. 3A is a perspective view of a conventional planar inverted-F antenna.
Figure 3B:
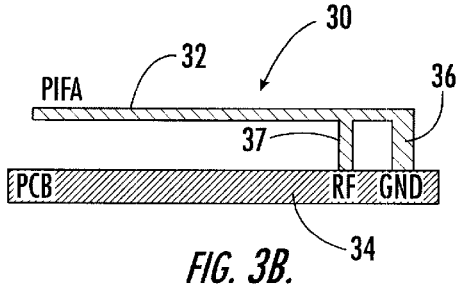
FIG. 3B. PRIOR ART
FIG. 3B is a side view of the conventional planar inverted-F antenna of FIG. 3A taken along lines 3B—3B.

Referring now to FIGS. 3A and 3B, a conventional inverted-F antenna 30 configured for use in a radiotelephone is illustrated. FIG. 3A is a perspective view of the inverted-F antenna 30 and FIG. 3B is a side view taken along lines 3B-3B in FIG. 3A. Conventional inverted-F antennas, such as the one illustrated in FIGS. 3A–3B, derive their name from their resemblance to the letter "F."

The illustrated antenna 30 includes a conductive element 32 maintained in spaced apart relationship with a ground plane 34. The illustrated conductive element 32 has first and second portions or branches 32*a,* 32*b,* which may be resonant in different respective frequency bands, as would be understood by those skilled in the art. The conductive element 32 is grounded to the ground plane 34 via a ground feed 36. A signal feed 37 extends from a signal receiver and/or transmitter (e.g., an RF transceiver) underlying or overlying the ground plane 34 to the conductive element 32, as would be understood by those of skill in the art.

Figure 4A:
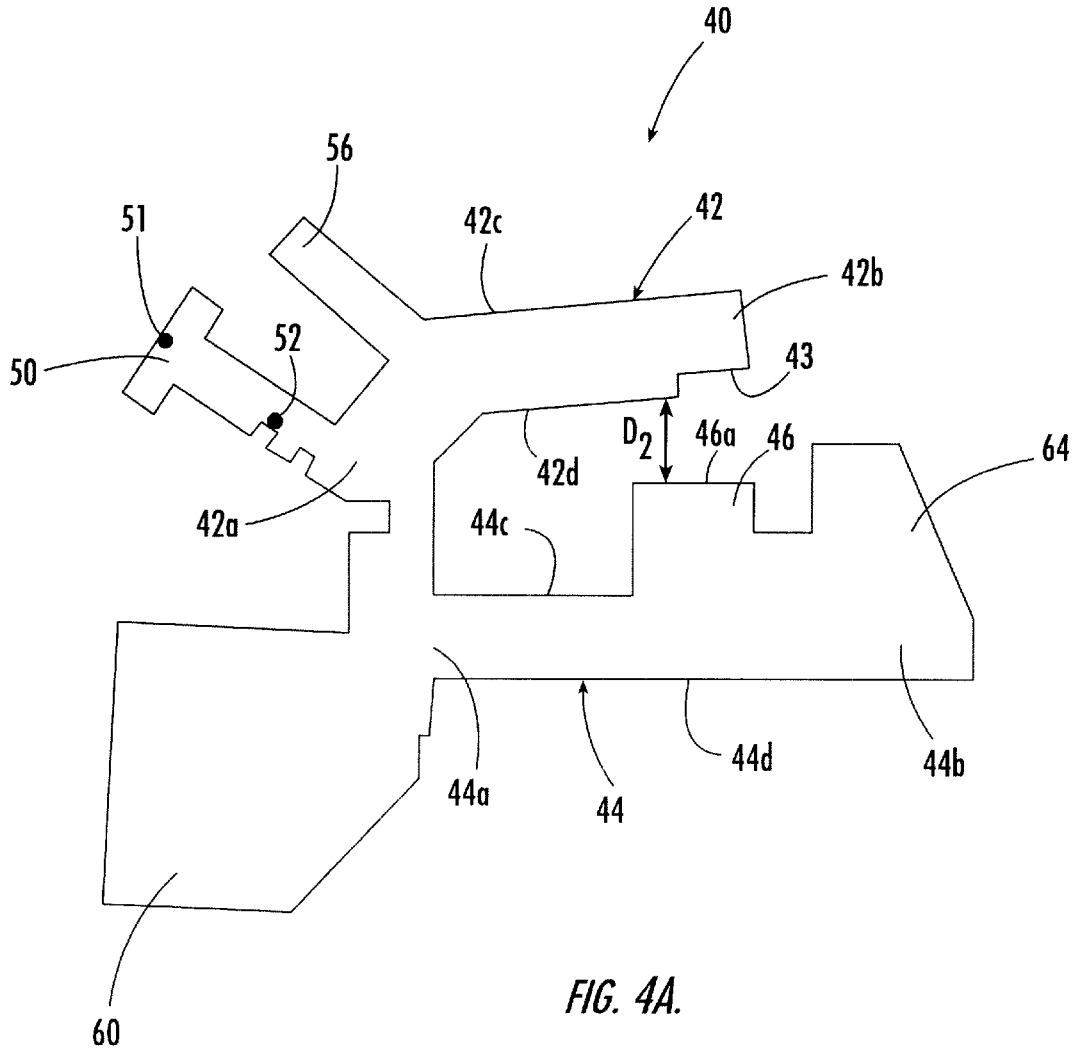
FIG. 4A is a plan view of a multi-frequency band antenna, according to embodiments of the present invention.

Referring now to FIG. 4A, a multi-frequency band antenna 40, according to embodiments of the present invention, that is configured for use within wireless communicators, such as radiotelephones, is illustrated. The illustrated multi-frequency band antenna 40 includes a first conductive branch 42 that is configured to radiate in a first frequency band, and a second conductive branch 44 that is configured to radiate in a second frequency band that is different from the first frequency band. The first frequency band may be a high frequency band and the second frequency band may be a low frequency band, or vice-versa, as would be understood by those of skill in the art. For example, a frequency band of the first conductive branch 42 may be between 1850 MHz and 1990 MHz (i.e., a high frequency band, such as a PCS frequency band) and a frequency band of the second conductive branch 44 be between 824 MHz and 894 MHz (i.e., a low frequency band, such as an AMPS frequency band).

The illustrated first conductive branch 42 includes opposite first and second end portions 42*a,* 42*b* and opposite first and second edge portions 42*c,* 42*d* that extend between the first and second end portions 42*a,* 42*b.* A notch 43 is formed in the second edge portion 42*d* adjacent the second end portion 42*b,* as illustrated.

Figure 4B:
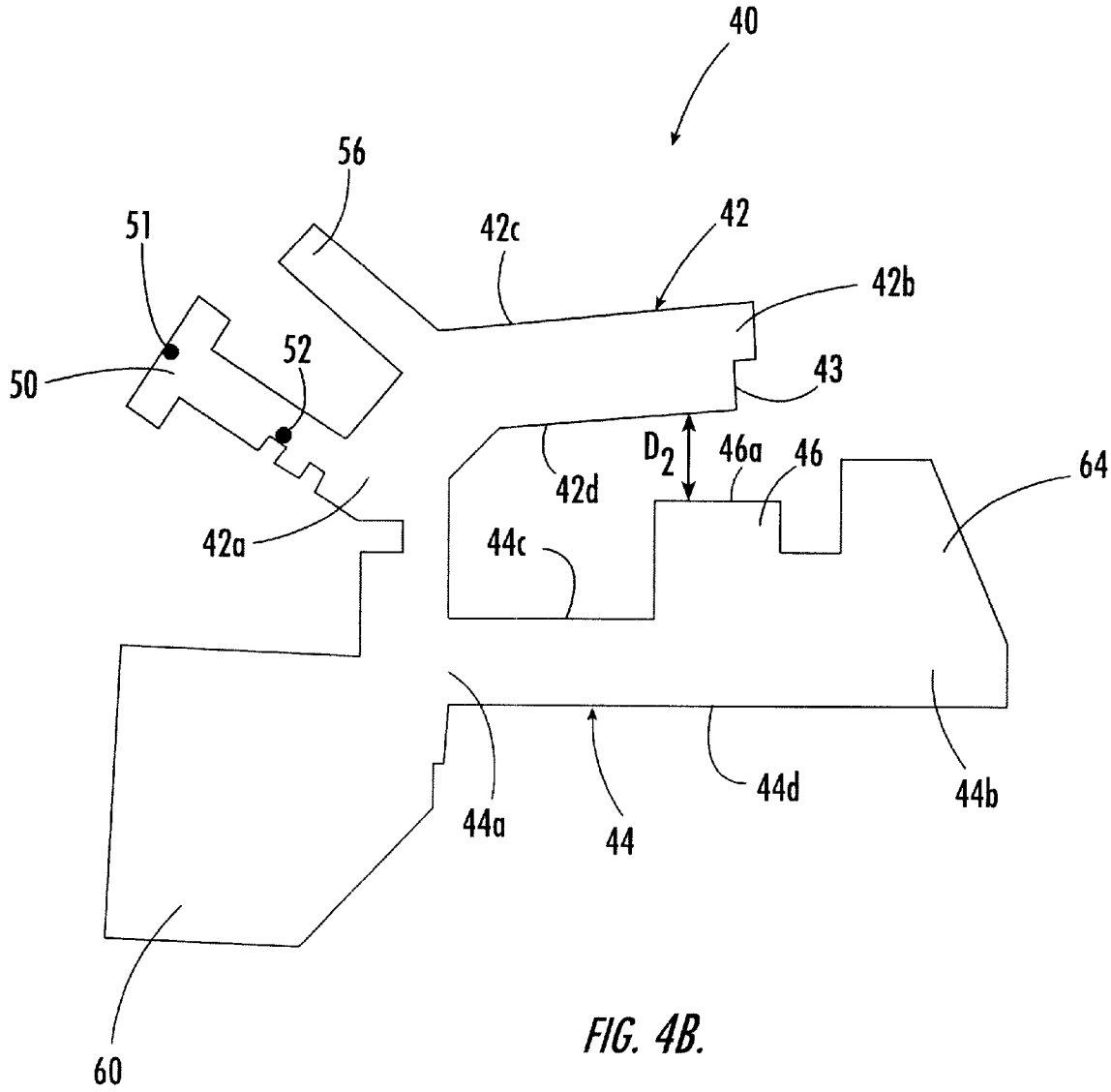
FIGS. 4B–4D are plan views of a multi-frequency band antenna, according to alternative embodiments of the present invention.
Figure 4C:
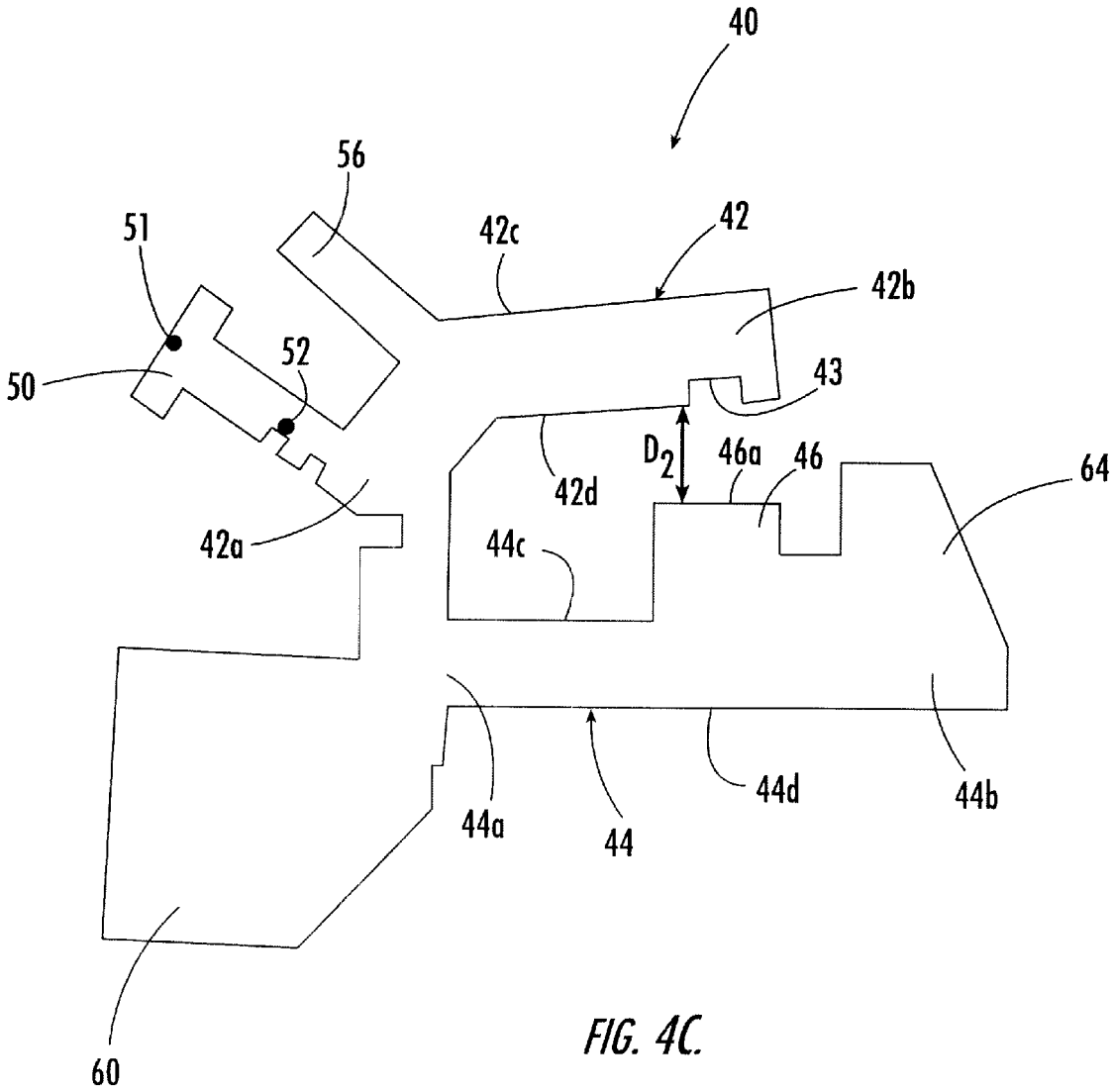
Figure 4D:
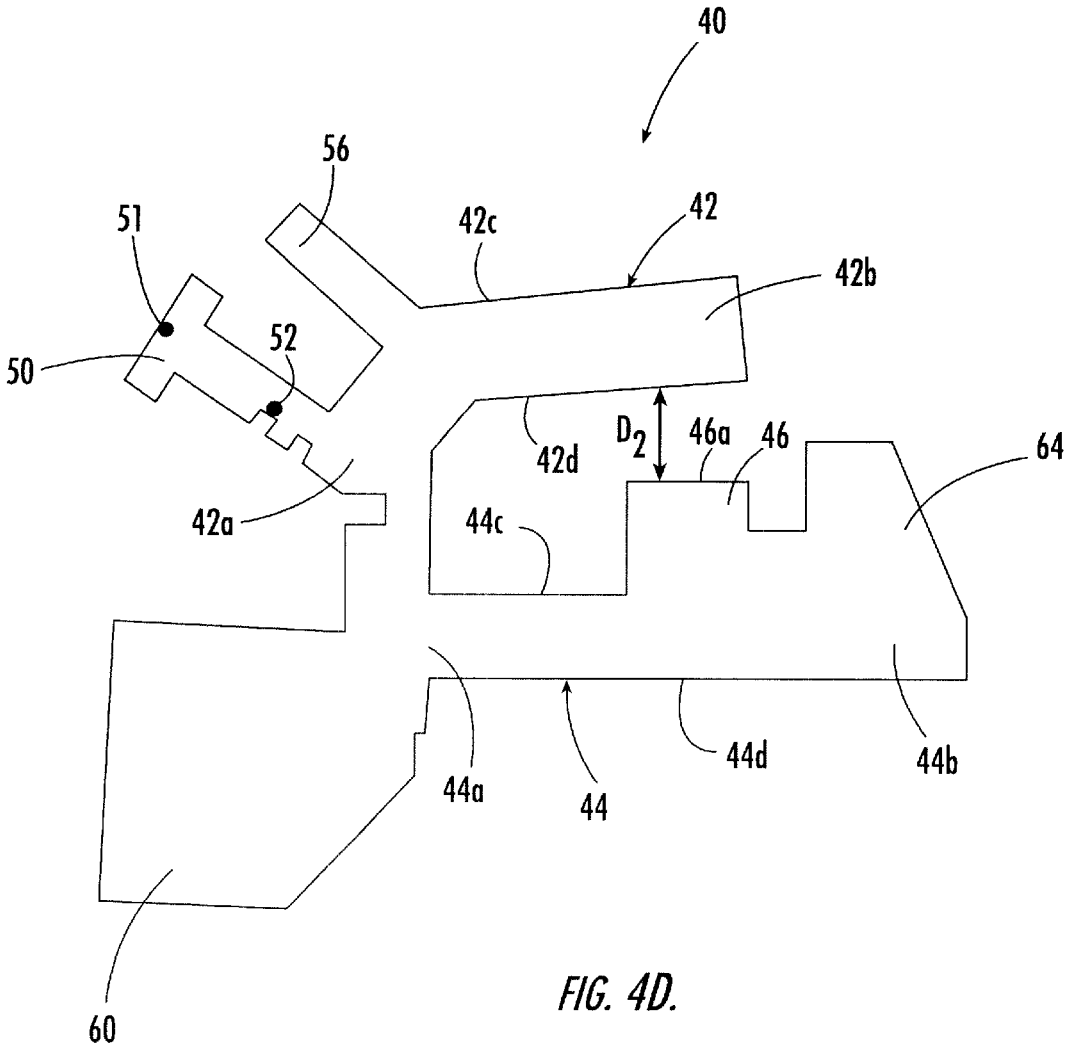

Embodiments of the present invention are not limited to the illustrated location and configuration of notch 43. Notch 43 may have various configurations and locations. FIGS. 4B–4C illustrate exemplary alternative embodiments with a notch having different locations and configurations. In addition, embodiments of the present invention may not require a notch (FIG. 4D).

The second conductive branch 44 includes opposite third and fourth end portions 44*a,* 44*b* and opposite third and fourth edge portions 44*c,* 44*d* that extend between the third and fourth end portions 44*a,* 44*b,* as illustrated. The first and second conductive branches 42, 44 are connected together at the first and third end portions 42*a,* 44*a* and are configured to electrically couple at the respective second and fourth end portions 42*b,* 44*b.* Coupling is utilized between the first and second conductive branches 42, 44 to achieve bandwidth and gain results desired for the antenna.

A first conductive element 46 having a free end 46*a* extends from the third edge portion 44*c* of the second conductive branch 44 adjacent the fourth end portion 44*b.* The first conductive element free end 46*a* is spaced-apart from the second edge portion 42*d* of the first conductive branch by a distance D. D is less than about ten millimeters (10 mm) and preferably less than about five millimeters (5 mm).

The notch 43 formed in the second edge portion 42*d* is in adjacent, spaced-apart relationship with at least a portion of the first conductive element free end 46*a,* as illustrated. The notch 43 facilitates electrical coupling between the first and second conductive branches 42, 44 so as to enhance at least one of the first and second frequency bands. The size and configuration of the notch 43 are tuning parameters. The notch 43 may have various shapes, sizes, and configurations depending on desired bandwidth and gain results for the antenna 40, and is not limited to the illustrated configuration.

Still referring to FIG. 4A, a second conductive element 50 extends from the first edge portion 42*c* of the first conductive branch 42 adjacent the first end portion 42*a,* as illustrated. The second conductive element 50 includes a wireless communications signal feed terminal 52 and a ground feed terminal 51. The second conductive element 50 may have various shapes, sizes, and configurations, and is not limited to the illustrated configuration.

In operation, a signal feed electrically connects the signal feed terminal 52 to a wireless communications signal receiver and/or transmitter (not shown), as would be understood by those skilled in the art. Similarly, a ground feed electrically connects the ground terminal 51 to ground, for example, via a ground plane.

A third conductive element 56 extends from the first edge portion 42*c* of the first conductive branch 42 at an intermediate location between the first and second end portions 42*a,* 42*b,* as illustrated. The third conductive element 56 is configured to tune the first frequency band. The size and configuration of the third conductive element 56 are tuning parameters. Accordingly, the third conductive element 56 may have various shapes, sizes, and configurations, and is not limited to the illustrated configuration.

The illustrated multi-frequency band antenna 40 also includes a fourth conductive element 60 that extends from the third end 44*a* of the second conductive branch 44. The fourth conductive element 60 is configured to tune both the first and second frequency bands. The size and configuration of the fourth conductive element 60 are tuning parameters. Accordingly, the fourth conductive element 60 may have various shapes, sizes, and configurations, and is not limited to the illustrated configuration.

The illustrated multi-frequency band antenna 40 also includes a fifth conductive element 64 that extends from the fourth end portion 44*b* of the second conductive branch 44. The fifth conductive element 64 is configured to tune the second frequency band. The size and configuration of the fifth conductive element 64 are tuning parameters. Accordingly, the fifth conductive element 64 may have various shapes, sizes, and configurations, and is not limited to the illustrated configuration.

Figure 5:
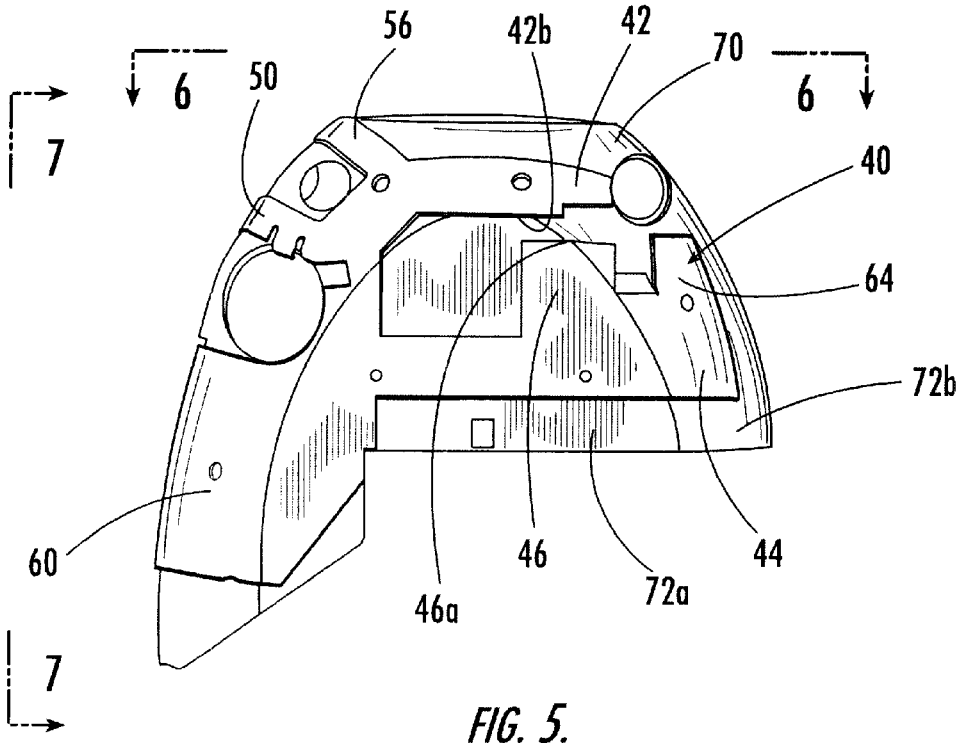
FIG. 5 is a plan view of the multi-frequency band antenna of FIG. 4A disposed on a three-dimensional dielectric substrate that is configured to be mounted internally within a radiotelephone.
Figure 6:
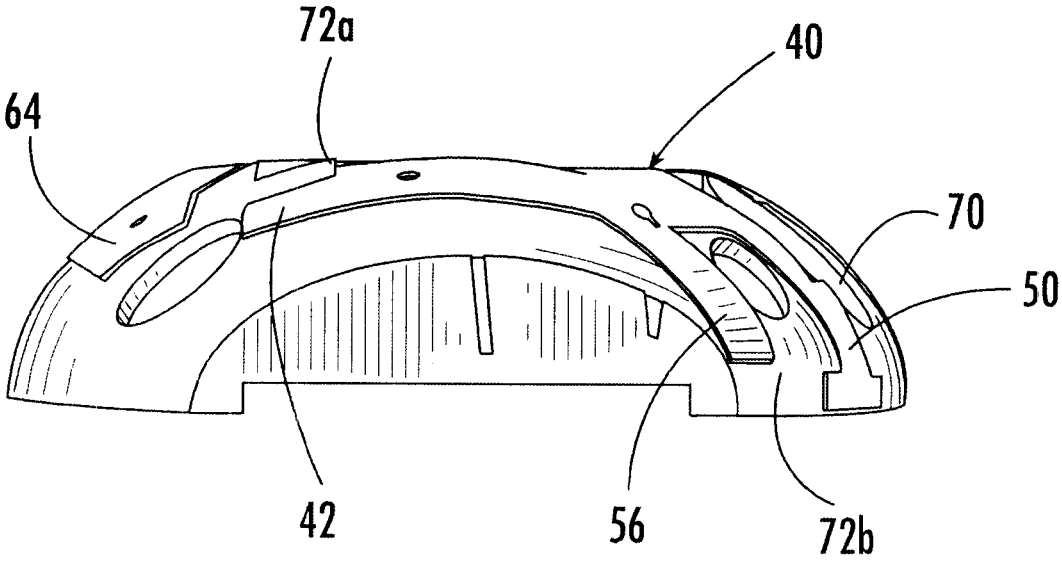
FIG. 6 is a side elevational view of the multi-frequency band antenna and dielectric substrate of FIG. 5 taken along lines 6—6.
Figure 7:
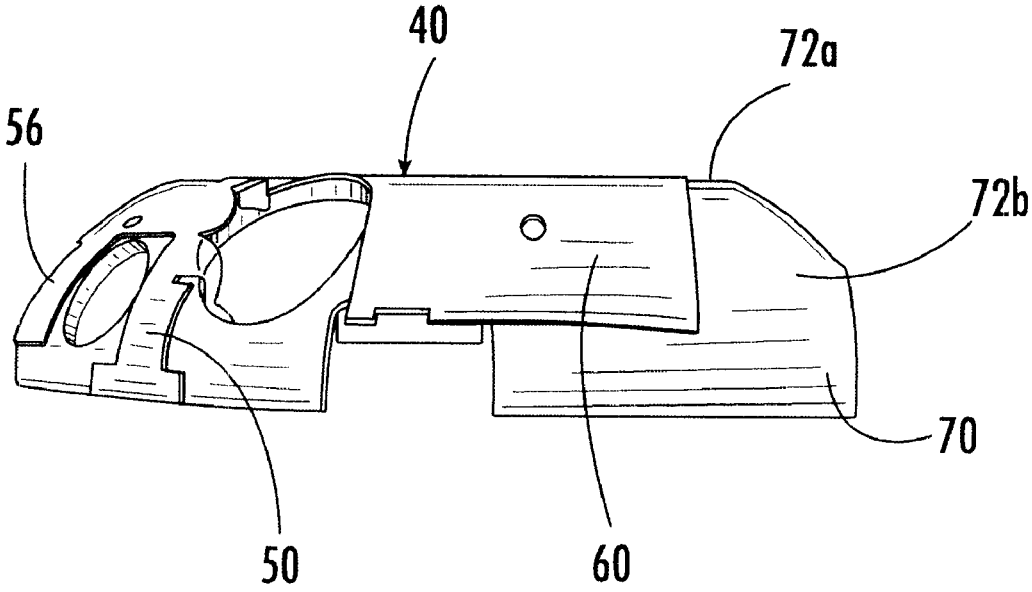
FIG. 7 is a side elevational view of the multi-frequency band antenna and dielectric substrate of FIG. 5 taken along lines 7—7.

Referring now to FIGS. 5–7, the multi-frequency band antenna 40 of FIG. 4A is configured to be disposed on a dielectric substrate 70 (e.g., PC ABS, liquid crystal polymer, etc.). FIG. 6 is a side elevational view of the multi-frequency band antenna 40 and dielectric substrate 70 of FIG. 5 taken along lines 6—6. FIG. 7 is a side elevational view of the multi-frequency band antenna 40 and dielectric substrate 70 of FIG. 5 taken along lines 7—7.

The illustrated dielectric substrate 70 has a surface 72 that includes a flat central portion 72*a,* and convex peripheral edge portion 72*b.* The multi-frequency band antenna 40 is configured to follow the contour of the dielectric substrate 70 when disposed thereon and, thus, to assume a three-dimensional configuration. In the illustrated embodiment, a portion of the first conductive branch second edge portion 42*d* and the first conductive element free end 46*a* are in substantially parallel, spaced-apart relationship. It is understood that multi-frequency band antennas according to embodiments of the present invention may be disposed on dielectric substrates having various shapes, sizes, and configurations.

The dielectric substrate 70 maintains the multi-frequency band antenna 40 in adjacent, spaced-apart relationship with a ground plane (e.g., a printed circuit board and/or shield can overlying a printed circuit board or other component) when the multi-frequency band antenna 40 is disposed within a wireless communicator.

As would be understood by those of skill in the art, multi-frequency band antennas according to embodiments of the present invention may be formed on the dielectric substrates, for example, by etching a metal layer or layers in a pattern on the dielectric substrate. Also, as would be understood by those of skill in the art, multi-frequency band antennas, according to embodiments of the present invention, may have any number of conductive branches and/or conductive elements disposed on and/or within a dielectric substrate.

A preferred conductive material out of which the conductive branches 42, 44 and/or conductive elements 46, 50, 56, 60, 64 of the illustrated multi-frequency band antenna 40 may be formed is copper. For example, the conductive branches 42, 44 and conductive elements 46, 50, 56, 60, 64 may be formed from copper sheet. Alternatively, the conductive branches 42, 44 and/or conductive elements 46, 50, 56, 60, 64 may be formed from a copper layer on a dielectric substrate. However, conductive branches 42, 44 and/or conductive elements 46, 50, 56, 60, 64 for multi-frequency band antennas according to the present invention may be formed from various conductive materials and are not limited to copper.

Multi-frequency band antennas according to embodiments of the present invention may have various shapes, configurations, and sizes. The present invention is not limited to the illustrated configuration of the multi-frequency band antenna 40 of FIG. 4A and FIG. 5. The illustrated conductive branches 42, 44 and the various conductive elements 46, 50, 56, 60, 64 may have various shapes, sizes, and configurations, and may extend in various relative orientations.

The first and second conductive branches 42, 44 are configured to electrically couple at the respective second and fourth ends 42*b*, 44*b*. As would be known by one of skill in the art, the term "coupling" refers to the association of two or more circuits or elements in such a way that power or signal information may be transferred from one to another. The first conductive branch 42 is configured to enhance at least one resonant frequency band of the second conductive branch 40 and vice-versa. The term "enhance" includes improving either VSWR performance or radiation performance or both. The term "enhance" also includes changing a resonant frequency band of an antenna to a preferred operating band.

Figure 8:
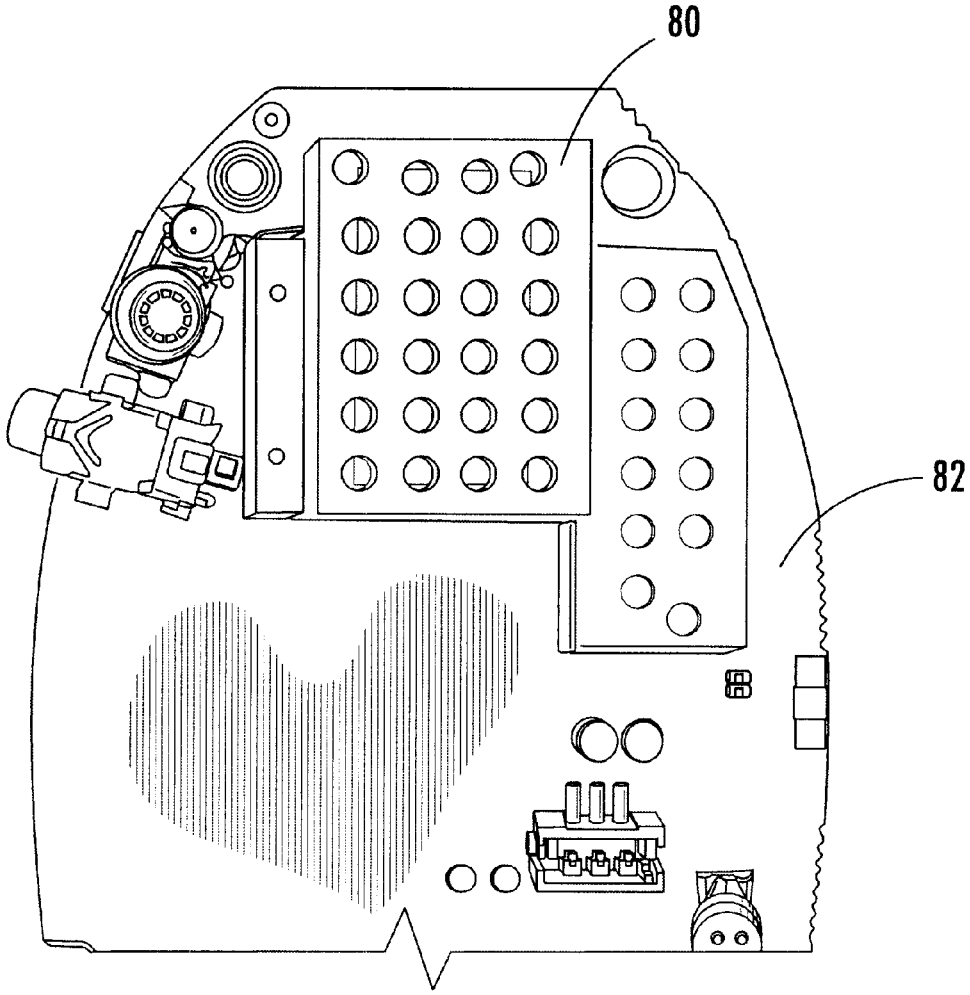
FIG. 8 is a plan view of a PCB having a shield can mounted thereto and which serves as a ground plane for the multi-frequency band antenna of FIG. 4A.
Figure 9:
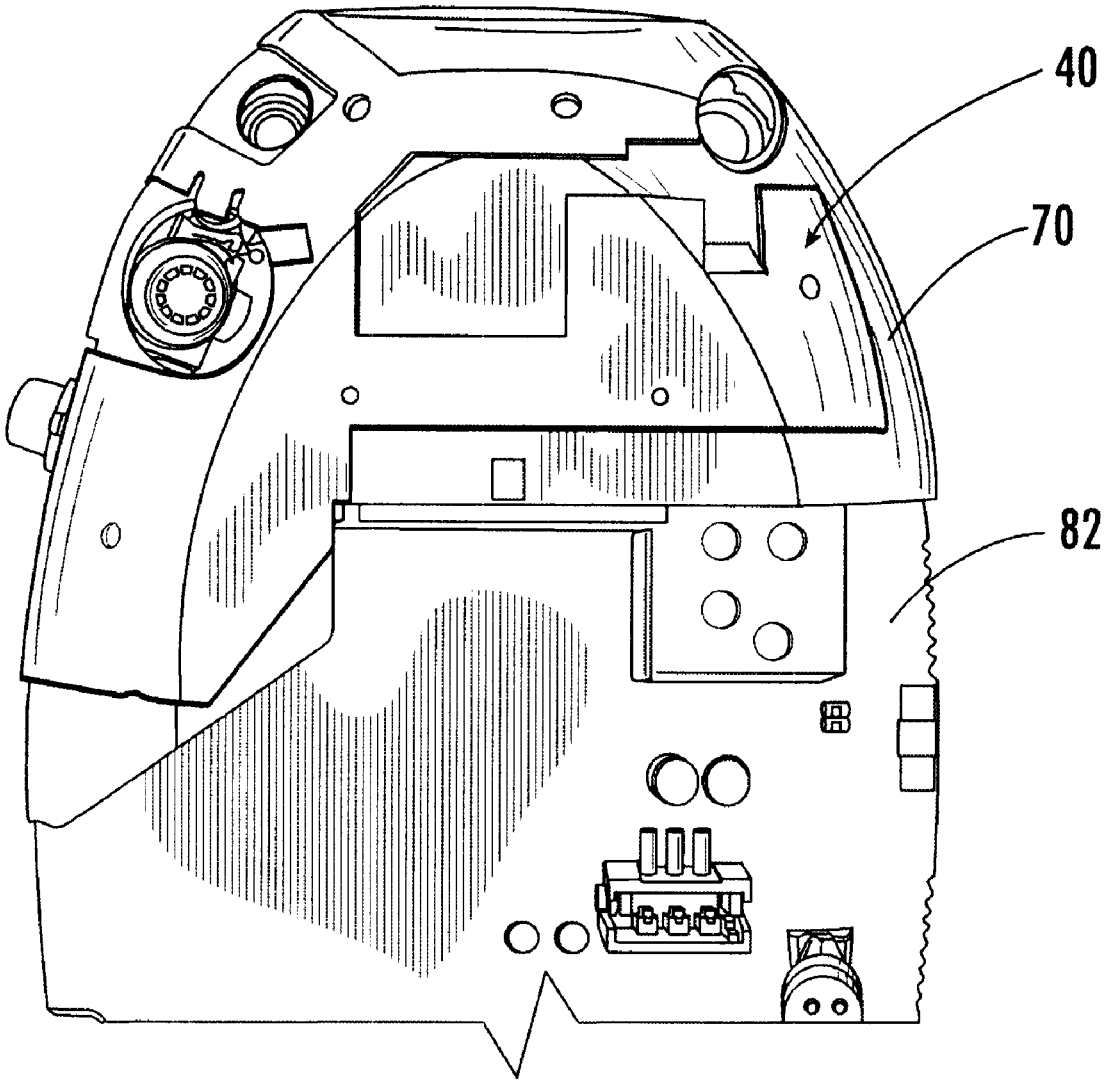
FIG. 9 is a plan view of the PCB of FIG. 8 with the multi-frequency band antenna and dielectric substrate of FIG. 5 in overlying, spaced-apart relationship with the ground plane.
Figure 10:
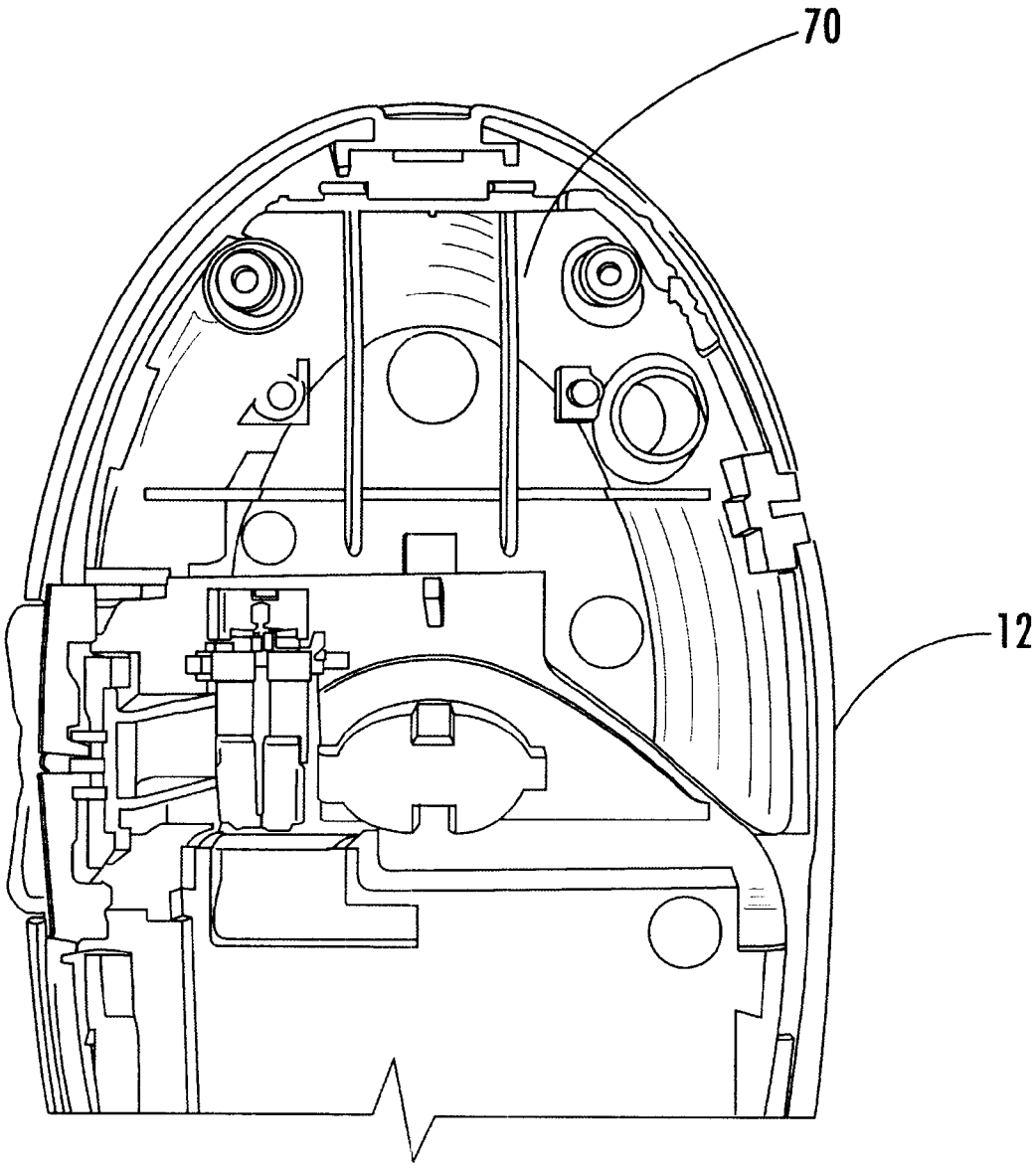
FIG. 10 is a plan view of the multi-frequency band antenna and substrate of FIG. 5 disposed within a portion of a housing of a radiotelephone.

Referring now to FIGS. 8–10, the multi-frequency band antenna 40 and dielectric substrate 70 of FIG. 5 are illustrated relative to a PCB and a housing of a wireless communicator, such as a radiotelephone. FIG. 8 illustrates a shield can 80 overlying a printed circuit board PCB 82. The shield can 80 serves as a ground plane over which the multi-frequency band antenna 40 of FIG. 4A is maintained in spaced-apart relationship via dielectric substrate 70.

FIG. 9 illustrates the multi-frequency band antenna 40 and dielectric substrate 70 in an installed configuration overlying the shield can 80 on the PCB 82 of FIG. 8. FIG. 10 illustrates a portion of a housing 12 of a wireless communicator, such as a radiotelephone. The multi-frequency band antenna. 40 and dielectric substrate 70 of FIG. 5 are disposed within the portion of the housing 12. (The PCB 82 of FIG. 9 is not shown for clarity.)

Multi-frequency band antennas according to embodiments of the present invention may be particularly well suited for use within wireless communicators, such as radiotelephones, wherein space limitations may limit the performance of internally mounted antennas. Multi-frequency band antennas according to other embodiments of the present invention may have various different configurations and orientations, shapes and sizes.

Figure 11:
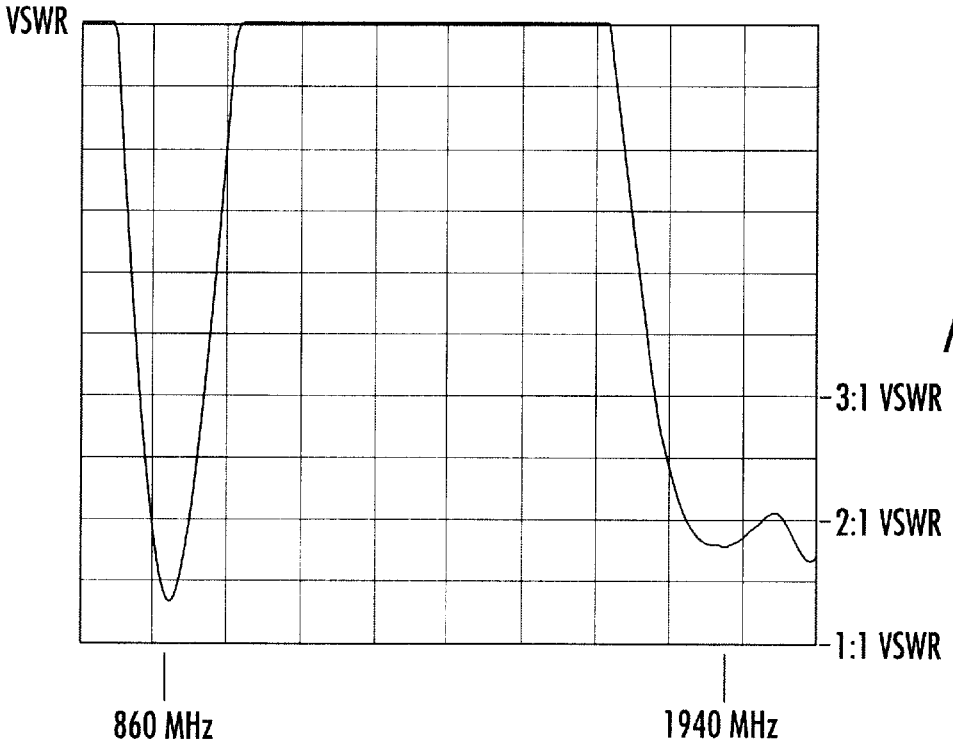
FIG. 11 is a graph of the VSWR performance of the multi-frequency band antenna of FIG. 4A.
Figure 12:
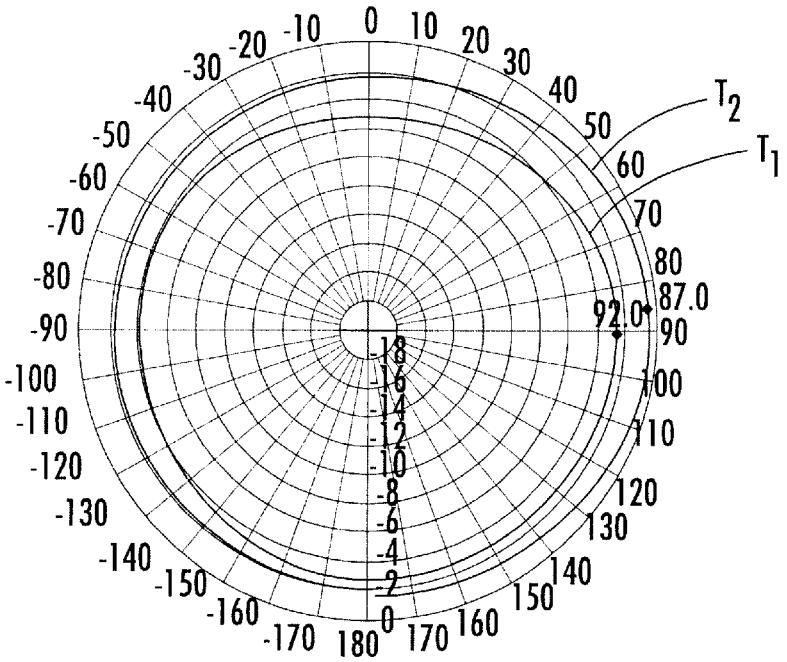
FIG. 12 is a graph of the radiation pattern of the multi-frequency band antenna of FIG. 4A.

Referring now to FIGS. 11–12, graphs of the VSWR performance of the illustrated multi-frequency band antenna 40 of FIG. 4A are illustrated. In FIG. 11, the multi-frequency band antenna 40 of FIG. 4A resonates around a first central frequency of about 860 MHz and around a second central frequency of about 1940 MHz. In FIG. 12, a graph of the radiation pattern of the multi-frequency band antenna 40 of FIG. 4A is illustrated. Trace $T_1$ represents the radiation pattern of a conventional internal PIFA antenna and trace $T_2$ represents the radiation pattern of the multi-frequency band antenna 40 of FIG. 4. The performance of the multi-frequency band antenna 40 of FIG. 4A (represented by $T_2$) is at least 2 dB better than the antenna represented by trace $T_1$.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A multi-frequency band antenna, comprising:

a first conductive branch that radiates in a first frequency band, comprising opposite first and second end portions and opposite first and second edge portions extending between the first and second end portions; and a if a second conductive branch that radiates in a second frequency band different from the first frequency band, comprising opposite third and fourth end portions and opposite third and fourth edge portions extending between the third and fourth end portions, wherein the first and second conductive branches are connected together at the first and third end portions, wherein a first conductive element having a free end extends from the third edge portion adjacent the fourth end portion such that the free end is in adjacent, spaced-apart relationship with the second edge portion of the first conductive branch and facilitates electrical coupling between the first and second conductive branches so as to enhance at least one of the first and second frequency bands, wherein a second conductive element extends from the first edge portion of the first conductive branch adjacent the first end portion, and wherein the second conductive element comprises a wireless communications signal feed terminal and a ground feed terminal.

2. The multi-frequency band antenna according to claim 1, further comprising a notch formed in the second edge portion adjacent the second end portion and in adjacent, spaced-apart relationship with at least a portion of the first conductive element free end, wherein the notch facilitates electrical coupling between the first and second conductive branches so as to enhance at least one of the first and second frequency bands.

3. The multi-frequency band antenna according to claim 1, wherein the free end of the first conductive element is spaced-apart from the second edge portion of the first conductive branch by a distance of less than about five millimeters (5 mm).

4. The multi-frequency band antenna according to claim 1, further comprising a third conductive element extending from the first edge portion of the first conductive branch at an intermediate location between the first and second end portions, wherein the third conductive element is configured to tune the first frequency band.

5. The multi-frequency band antenna according to claim 4, further comprising a fourth conductive element extending from the third end portion of the second conductive branch, wherein the fourth conductive element is configured to tune both the first and second frequency bands.

6. The multi-frequency band antenna according to claim 5, further comprising a fifth conductive element extending from the fourth end portion of the second conductive branch, wherein the fifth conductive element is configured to tune the second frequency band.

7. The multi-frequency band antenna according to claim 1 wherein the first frequency band is a PCS frequency band and wherein the second frequency band is an AMPS frequency band.

8. The multi-frequency band antenna according to claim 1, further comprising a dielectric substrate having a convex surface, and wherein the first and second conductive branches are disposed on the convex surface.

9. The multi-frequency band antenna according to claim 8, wherein a portion of the second edge portion of the first conductive branch and the free end of the first conductive element are in substantially parallel, spaced-apart relationship.

10. A multi-frequency band antenna, comprising:

a first conductive branch that radiates in a first frequency band, comprising opposite first and second end portions and opposite first and second edge portions extending between the first and second end portions;

a second conductive branch that radiates in a second frequency band different from the first frequency band, comprising opposite third and fourth end portions and opposite third and fourth edge portions extending between the third and fourth end portions, wherein the first and second conductive branches are connected together at the first and third end portions, wherein a first conductive element having a free end extends from the third edge portion adjacent the fourth end portion such that the free end is spaced-apart from the second edge portion of the first conductive branch by a distance of less than about five millimeters (5 mm) and facilitates electrical coupling between first and second conductive branches so as to enhance at least one of the first and second frequency bands;

a second conductive element extending from the first edge portion of the first conductive branch adjacent the first end portion, wherein the second conductive element comprises a wireless communications signal feed terminal and a ground feed terminal;

a third conductive element extending from the first edge portion of the first conductive branch at an intermediate location between the first and second end portions, wherein the third conductive element is configured to tune the first frequency band; and a fourth conductive element extending from the third end of the second conductive branch, wherein the fourth conductive element is configured to tune both the first and second frequency bands.

11. The multi-frequency band antenna according to claim 10, further comprising a notch formed in the second edge portion adjacent the second end portion and in adjacent, spaced-apart relationship with at least a portion of the first conductive element free end, wherein the notch facilitates electrical coupling between the first and second conductive branches so as to enhance at least one of the first and second frequency bands.

12. The multi-frequency band antenna according to claim 10, further comprising a fifth conductive element extending from the fourth end portion of the second conductive branch, wherein the fifth conductive element is configured to tune the second frequency band.

13. The multi-frequency band antenna according to claim 10 wherein the first frequency band is a PCS frequency band and wherein the second frequency band is an AMPS frequency band.

14. The multi-frequency band antenna according to claim 10, further comprising a dielectric substrate having a convex surface, and wherein the first and second conductive branches are disposed on the convex surface.

15. The multi-frequency band antenna according to claim 14, wherein a portion of the second edge portion of the first conductive branch and the free end of the first conductive element are in substantially parallel, spaced-apart relationship.

16. A wireless communicator, comprising:

a housing configured to enclose a receiver that receives wireless communications signals and/or a transmitter that transmits wireless communications signals;

a ground plane disposed within the housing;

a multi-frequency band antenna disposed within the housing in adjacent, spaced-apart relationship with the ground plane, wherein the multi-frequency band antenna comprises:

a first conductive branch that radiates in a first frequency band, comprising opposite first and second end portions and opposite first and second edge portions extending between the first and second end portions;

a second conductive branch that radiates in a second frequency band different from the first frequency band, comprising opposite third and fourth end portions and opposite third and fourth edge portions extending between the third and fourth end portions, wherein the first and second conductive branches are connected together at the first and third end portions, wherein a first conductive element having a free end extends from the third edge portion adjacent the fourth end portion such that the free end is in adjacent, spaced-apart relationship with the second edge portion of the first conductive branch and facilitates capacitive coupling between first and second conductive branches, wherein a second conductive element extends from the first edge portion of the first conductive branch adjacent the first end portion, and wherein the second conductive element comprises a wireless communications signal feed terminal that is connected to a receiver that receives wireless communications signals, and/or to a transmitter that transmits wireless communications signals, and a ground feed terminal connected to ground;

a third conductive element extending from the first edge portion of the first conductive branch at an intermediate location between the first and second end portions, wherein the third conductive element is configured to tune the first frequency band; and a fourth conductive element extending from the third end of the second conductive branch, wherein the fourth conductive element is configured to tune both the first and second frequency bands.

17. The wireless communicator according to claim 16, further comprising a notch formed in the second edge portion adjacent the second end portion and in adjacent, spaced-apart relationship with at least a portion of the first conductive element free end, wherein the notch facilitates electrical coupling between the first and second conductive branches so as to enhance at least one of the first and second frequency bands.

18. The wireless communicator according to claim 16, wherein the free end of the first conductive element is spaced-apart from the second edge portion of the first conductive branch by a distance of less than about five millimeters (5 mm).

19. The wireless communicator according to claim 16, further comprising a fifth conductive element extending from the fourth end portion of the second conductive branch, wherein the fifth conductive element is configured to tune the second frequency band.

20. The wireless communicator according to claim 16 wherein the first frequency band is a PCS frequency band and wherein the second frequency band is an AMPS frequency band.

21. The wireless communicator according to claim 16, further comprising a dielectric substrate having a convex surface, and wherein the first and second conductive branches are disposed on the convex surface.

22. The wireless communicator according to claim 21, wherein a portion of the second edge portion of the first conductive branch and the free end of the first conductive element are in substantially parallel, spaced-apart relationship.

23. The wireless communicator according to claim 16, wherein the ground plane comprises a printed circuit board (PCB).

24. The wireless communicator according to claim 16, wherein the ground plane comprises a shield can disposed within the housing.

25. The wireless communicator according to claim 16, wherein the wireless communicator comprises a radiotelephone.

26. A wireless communicator, comprising:

a housing configured to enclose a receiver that receives wireless communications signals and/or a transmitter that transmits wireless communications signals;

a ground plane disposed within the housing;

a multi-frequency band antenna disposed within the housing in adjacent, spaced-apart relationship with the ground plane, wherein the multi-frequency band antenna comprises:

a first conductive branch that radiates in a first frequency band, comprising opposite first and second end portions and opposite first and second edge portions extending between the first and second end portions;

a second conductive branch that radiates in a second frequency band different from the first frequency band, comprising opposite third and fourth end portions and opposite third and fourth edge portions extending between the third and fourth end portions, wherein the first and second conductive branches are connected together at the first and third end portions, wherein a first conductive element having a free end extends from the third edge portion adjacent the fourth end portion such that the free end is spaced-apart from the second edge portion of the first conductive branch by a distance of less than about five millimeters (5 mm) and facilitates electrical coupling between first and second conductive branches so as to enhance at least one of the first and second frequency bands;

a second conductive element extending from the first edge portion of the first conductive branch adjacent the first end portion, wherein the second conductive element comprises a wireless communications signal feed terminal that is connected to a receiver that receives wireless communications signals, and/or to a transmitter that transmits wireless communications signals, and a ground feed terminal connected to ground; and a third conductive element extending from the first edge portion of the first conductive branch at an intermediate location between the first and second end portions, wherein the third conductive element is configured to tune the first frequency band.

27. The wireless communicator according to claim 26, further comprising a notch formed in the second edge portion adjacent the second end portion and in adjacent, spaced-apart relationship with at least a portion of the first conductive element free end, wherein the notch facilitates electrical coupling between the first and second conductive branches so as to enhance at least one of the first and second frequency bands.

28. The wireless communicator according to claim 26, further comprising a fourth conductive element extending from the third end portion of the second conductive branch, wherein the fourth conductive element is configured to tune both the first and second frequency bands.

29. The wireless communicator according to claim 28, further comprising a fifth conductive element extending from the fourth end portion of the second conductive branch, wherein the fifth conductive element is configured to tune the second frequency band.

30. The wireless communicator according to claim 26 wherein the first frequency band is a PCS frequency band and wherein the second frequency band is an AMPS frequency band.

31. The wireless communicator according to claim 26, further comprising a dielectric substrate having a convex surface, and wherein the first and second conductive branches are disposed on the convex surface.

32. The wireless communicator according to claim 31, therein a portion of the second edge portion of the first conductive branch and the free end of the first conductive element are in substantially parallel, spaced-apart relationship.

33. The wireless communicator according to claim 26, wherein the ground plane comprises a printed circuit board (PCB).

34. The wireless communicator according to claim 26, wherein the ground plane comprises a shield can disposed within the housing.

35. The wireless communicator according to claim 26, wherein the wireless communicator comprises a radiotelephone.

* * * * *

UNITED STATES PATENT AND TRADEMARK OFFICE

CERTIFICATE OF CORRECTION

PATENT NO. : 6,563,466 B2
DATED : May 13, 2003
INVENTOR(S) : Sadler et al.

It is certified that error appears in the above-identified patent and that said Letters Patent is hereby corrected as shown below:

Column 8,
Line 61, should read -- a second conductive branch that radiates in a second --

Signed and Sealed this

Fourteenth Day of October, 2003

JAMES E. ROGAN
*Director of the United States Patent and Trademark Office*